US009784188B2

(12) United States Patent
Nishimoto et al.

(10) Patent No.: US 9,784,188 B2
(45) Date of Patent: Oct. 10, 2017

(54) SENSOR MODULE

(71) Applicant: DENSO CORPORATION, Kariya, Aichi-pref. (JP)

(72) Inventors: Seiji Nishimoto, Obu (JP); Yoshiyuki Kono, Obu (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/595,457

(22) Filed: Jan. 13, 2015

(65) Prior Publication Data

US 2015/0198101 A1 Jul. 16, 2015

(30) Foreign Application Priority Data

Jan. 14, 2014 (JP) ..... 2014-4130

(51) Int. Cl.
*F02D 11/10* (2006.01)
*F02D 9/10* (2006.01)

(52) U.S. Cl.
CPC ..... *F02D 9/105* (2013.01); *F02D 11/106* (2013.01); *F02D 2400/18* (2013.01)

(58) Field of Classification Search
CPC ..... F02D 9/105; F02D 11/106
USPC ..... 123/350, 337, 399
See application file for complete search history.

(56) References Cited

U.S. PATENT DOCUMENTS 5,490,487 A * 2/1996 Kato ..... F02D 11/10 123/399
5,868,114 A * 2/1999 Kamimura ..... F02D 9/105 123/399
6,067,958 A * 5/2000 Kamimura ..... F02D 9/1065 123/337
6,626,143 B1 * 9/2003 Wayama ..... F02D 9/00 123/399
6,691,678 B1 * 2/2004 Hashimoto ..... F02D 9/105 123/399

(Continued)

FOREIGN PATENT DOCUMENTS

JP 2011-047656 3/2011

OTHER PUBLICATIONS

Office Action (1 page) dated Feb. 16, 2016, issued in English translation corresponding Japanese Application No. 2014-004130 and English translation (2 pages).

*Primary Examiner* — Marguerite McMahon
*Assistant Examiner* — James Kim
(74) *Attorney, Agent, or Firm* — Nixon & Vanderhye PC

(57) ABSTRACT

A sensor module is adapted to be attached to an actuator body incorporating an electric actuator. The sensor module includes a sensor assembly, a sensor cover, and a connector housing. The sensor assembly includes a sensor detection part and a sensor housing. The sensor detection part is configured to detect a physical change amount of a driven body driven by the electric actuator and to convert the physical change amount into an electrical signal. The sensor housing incorporates the sensor detection part. The sensor cover is provided separately from the sensor housing and is attached to the actuator body. The sensor module is configured integrally by attaching the sensor assembly to the sensor cover. A connector terminal electrically connected to a connection terminal of the sensor detection part is insert-molded in the connector housing. The connector housing is provided integrally with the sensor housing.

3 Claims, 5 Drawing Sheets

(56) References Cited

U.S. PATENT DOCUMENTS

| | | | | |
|---|---|---|---|---|
| 2005/0109315 | A1* | 5/2005 | Kamimura | F02D 9/1065 123/399 |
| 2005/0155575 | A1* | 7/2005 | Ikeda | F02D 11/106 123/399 |
| 2008/0121831 | A1* | 5/2008 | Ikeda | F02D 9/105 251/129.11 |
| 2010/0319658 | A1* | 12/2010 | Uchiyama | F02D 9/105 123/337 |
| 2012/0181641 | A1* | 7/2012 | Hiramoto | F02D 9/107 257/421 |
| 2013/0063137 | A1 | 3/2013 | Ikeda et al. | |

* cited by examiner

SENSOR MODULE

CROSS REFERENCE TO RELATED APPLICATION

This application is based on Japanese Patent Application No. 2014-4130 filed on Jan. 14, 2014, the disclosure of which is incorporated herein by reference.

TECHNICAL FIELD

The present disclosure relates to a sensor module with a sensor assembly configured separately from a sensor cover.

BACKGROUND

An electronic throttle described in Japanese Patent No. 5212488 is known as a conventional technology. This electronic throttle includes a throttle body that accommodates a throttle valve, and a sensor module that is attached to this throttle body. The sensor module includes a throttle opening degree sensor that detects a rotation angle of the throttle valve, and a sensor cover that holds this throttle opening degree sensor. For the sensor cover, there are provided a connector for wiring connection with an electronic control unit (ECU), and a wiring unit for electrically connecting together the throttle opening degree sensor and a connection terminal in the connector.

The wiring unit includes a connecting member extending from the connector to a central part of the sensor cover in its width direction, and a wiring member extending from the central part of the sensor cover in its width direction to the vicinity of the sensor. A first connection terminal provided for the connecting member, and a second connection terminal provided for the wiring member are electrically joined to the wiring unit. As a result of the above-described configuration, when it becomes necessary to change a position of the connector due to, for example, a constraint on location for installation of the electronic throttle, the wiring unit does not need to be changed, and the same type of sensor cover with only a connector position different can be used.

However, according to the conventional technology described in Japanese Patent No. 5212488, in case of not only the change of the connector position but also a change of an attachment shape of the sensor cover, a design change particularly for small-quantity production or special shapes cannot be dealt with. Moreover, elaboration of accuracy such as an attachment position of the sensor is necessary at the time of the change of the attachment shape of the sensor cover. Accordingly, there is an issue of a significant increase in cost.

SUMMARY

The present disclosure addresses at least one of the above issues. Thus, it is an objective of the present disclosure to provide a sensor module that can deal with a change in shape of a sensor cover at low cost and that can minimize elaboration of accuracy relevant to an attachment position of a sensor.

To achieve the objective of the present disclosure, there is provided a sensor module adapted to be attached to an actuator body incorporating an electric actuator. The sensor module includes a sensor assembly, a sensor cover, and a connector housing. The sensor assembly includes a sensor detection part and a sensor housing. The sensor detection part is configured to detect a physical change amount of a driven body driven by the electric actuator and to convert the physical change amount into an electrical signal. The sensor housing incorporates the sensor detection part. The sensor cover is provided separately from the sensor housing and is attached to the actuator body. The sensor module is configured integrally by attaching the sensor assembly to the sensor cover. A connector terminal electrically connected to a connection terminal of the sensor detection part is insert-molded in the connector housing. The connector housing is provided integrally with the sensor housing.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Embodiments for the present disclosure will be described in detail below.

First Embodiment

Figure 1:
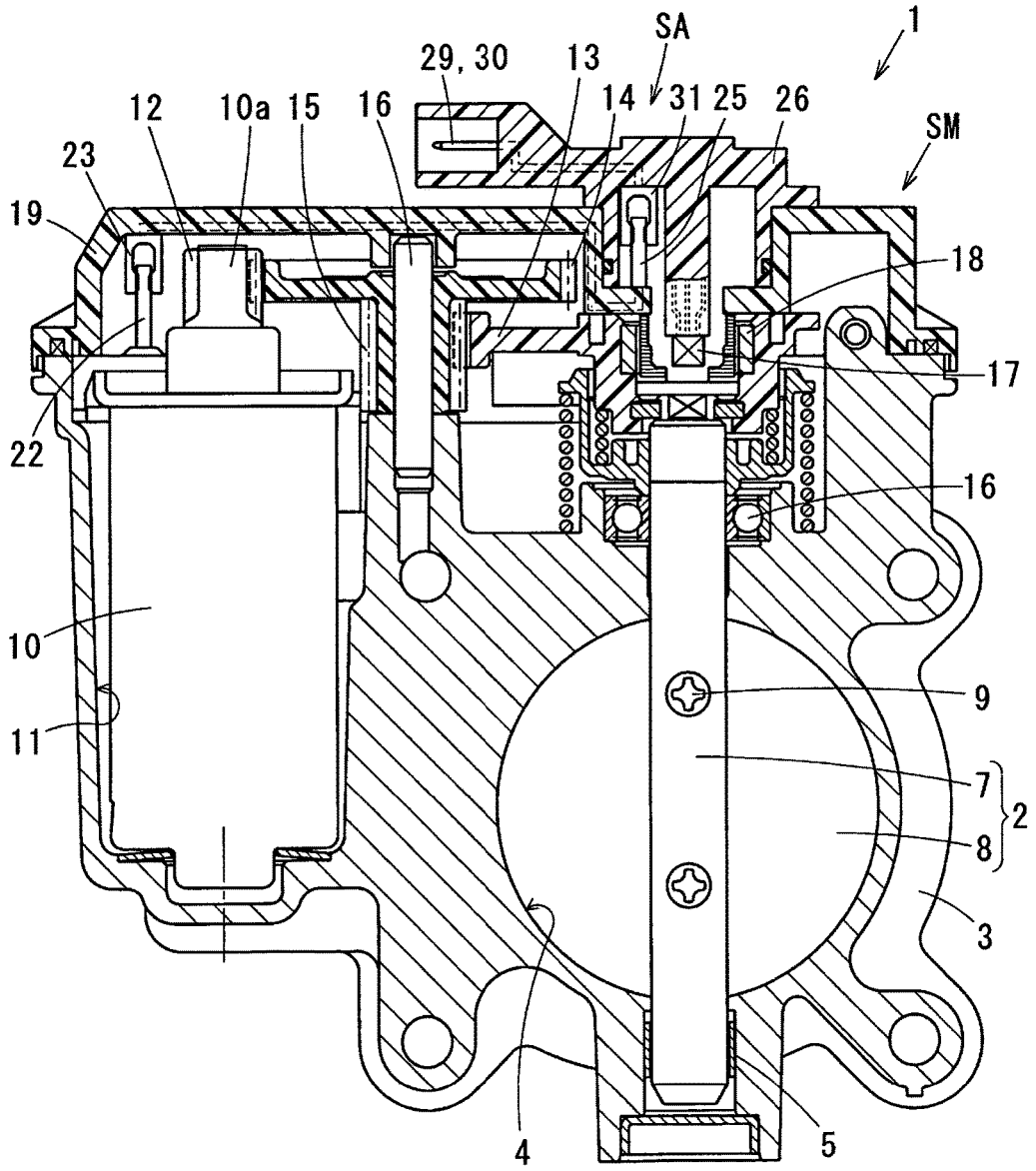
FIG. 1 is a sectional view illustrating an electronic throttle in accordance with a first embodiment.

In a first embodiment, there will be described an example of application of a sensor module of the present disclosure to an electronic throttle for adjusting an intake air amount of an engine. As illustrated in FIG. 1, an electronic throttle 1 includes a throttle body 3 integrating a throttle valve 2, a valve driving means (described later) for driving the throttle valve 2, and a sensor module SM in which a throttle opening degree sensor (described later) for detecting an opening degree of the throttle valve 2 is incorporated. The throttle body 3 is made, for example, by aluminium die casting, and includes a cylindrical air passage 4 in which intake air flows. An upstream-side open end of the air passage 4 is connected to an air cleaner (not shown) through an air hose or the like, and a downstream-side open end of the air passage 4 is connected to an intake manifold or surge tank (not shown).

The throttle valve 2 includes a shaft 7 that is rotatably supported by the throttle body 3 via bearings 5, 6, and a circular disk-shaped valving element 8 that is fixed to this shaft 7. As a concrete example of the bearing 5, 6, FIG. 1 illustrates that a plain bearing is used for the bearing 5, and a ball bearing is used for the bearing 6. The shaft 7 and the valving element 8 are attached together, for example, by inserting the valving element 8 into a slit formed at the shaft 7. The valving element 8 is fixed to the shaft 7 by fastening the valving element 8 to the shaft 7 via a screw 9. This throttle valve 2 is rotatable between a valve fully-closed position (position indicated in FIG. 1) at which the valving element 8 fully closes the air passage 4, and a valve fully-open position at which the valving element 8 fully opens the air passage 4.

The valve driving means includes a motor (electric actuator) 10 that generates torque upon supply of electric power, and a gear train (described later) that transmits this torque of the motor 10 to the shaft 7. The motor 10 is, for example, a widely-known direct current motor, and is accommodated in a motor chamber 11 which is formed in the throttle body 3 to be controlled by an ECU (not shown) via a motor drive circuit (not shown). The ECU calculates a target throttle opening degree based on outputted information from an accelerator opening degree sensor (not shown) that detects a pressing amount of an accelerator pedal, and performs feedback control on the electric power supplied to the motor 10 such that the actual opening degree of the throttle valve 2 detected by the throttle opening degree sensor coincides with the target throttle opening degree.

The gear train is a gear deceleration means which is configured by combination of spur gears. Specifically, the gear train includes a motor gear 12 that is provided for an output shaft 10*a* of the motor 10, a valve gear 13 that is attached to one end part of the shaft 7, and intermediate gears 14, 15 that transmit rotation of the motor gear 12 to the valve gear 13. The intermediate gears 14, 15 include a large-diameter gear 14 in engagement with the motor gear 12, and a small-diameter gear 15 in engagement with the valve gear 13. Both the gears 14, 15 are integrally formed concentrically and supported rotatably by a common intermediate shaft 16. The throttle opening degree sensor is, for example, a position sensor of non-contact type using a Hall IC 17, and detects a rotational position of a permanent magnet 18 attached to the inner periphery of the valve gear 13 to output an electrical signal in proportion to the magnitude of a magnetic field produced by the permanent magnet 18.

Figure 2:
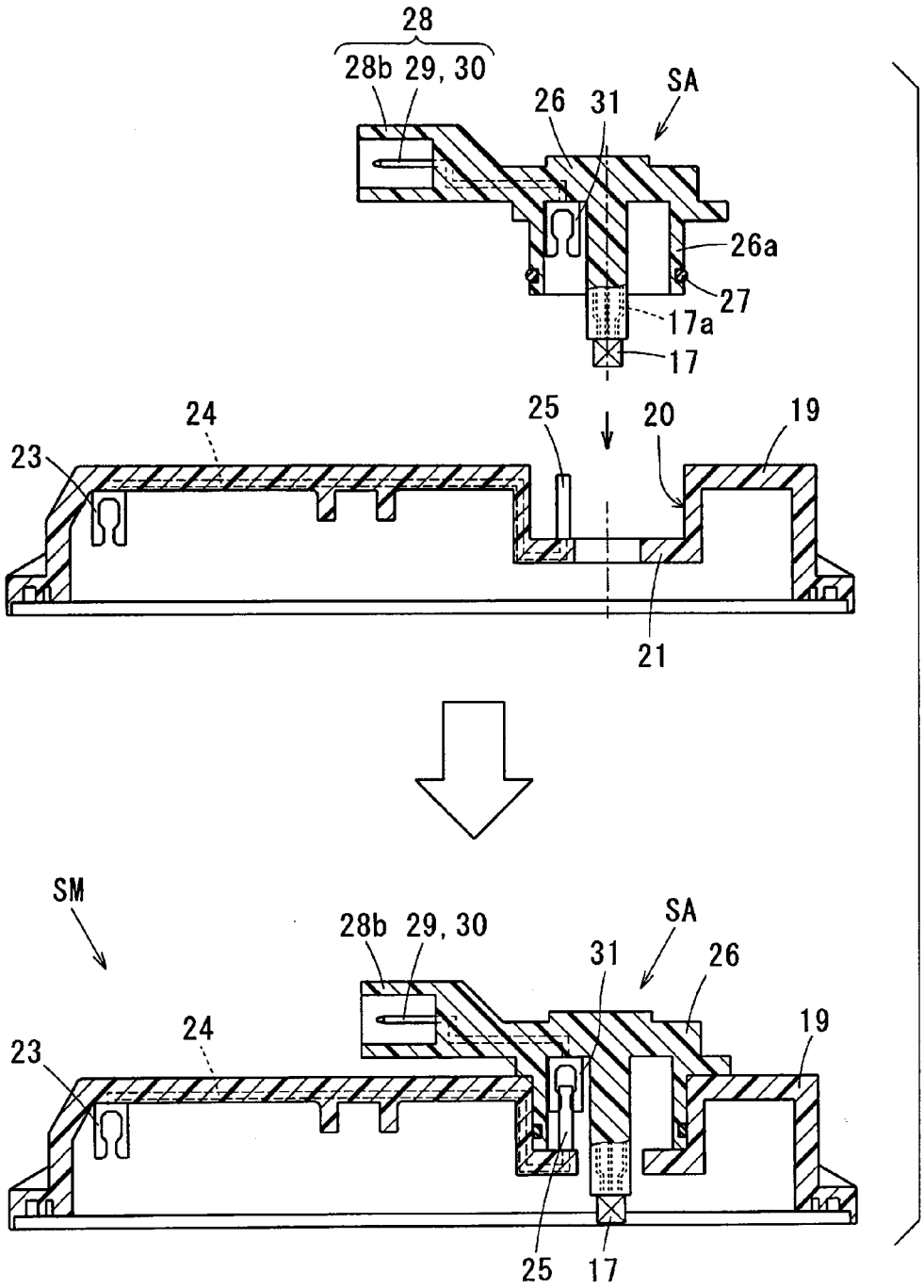
FIG. 2 is a sectional view illustrating a sensor module in accordance with the first embodiment.

The sensor module SM of the present disclosure will be described below. The sensor module SM includes a sensor cover 19 that is attached to the throttle body 3, and a sensor assembly SA that is attached to this sensor cover 19. As illustrated in FIG. 2, the sensor cover 19 includes an attachment hole 20 for attachment of the sensor assembly SA. The attachment hole 20 is formed in a cylindrical shape that opens to be circular in cross-section and has a predetermined length (length in upper and lower directions in FIG. 2). An ASSY receiving surface 21 projecting toward the inner periphery of the attachment hole 20 is formed along the whole circumference on a lower end side of the attachment hole 20 in the length direction in FIG. 2.

Figure 4:
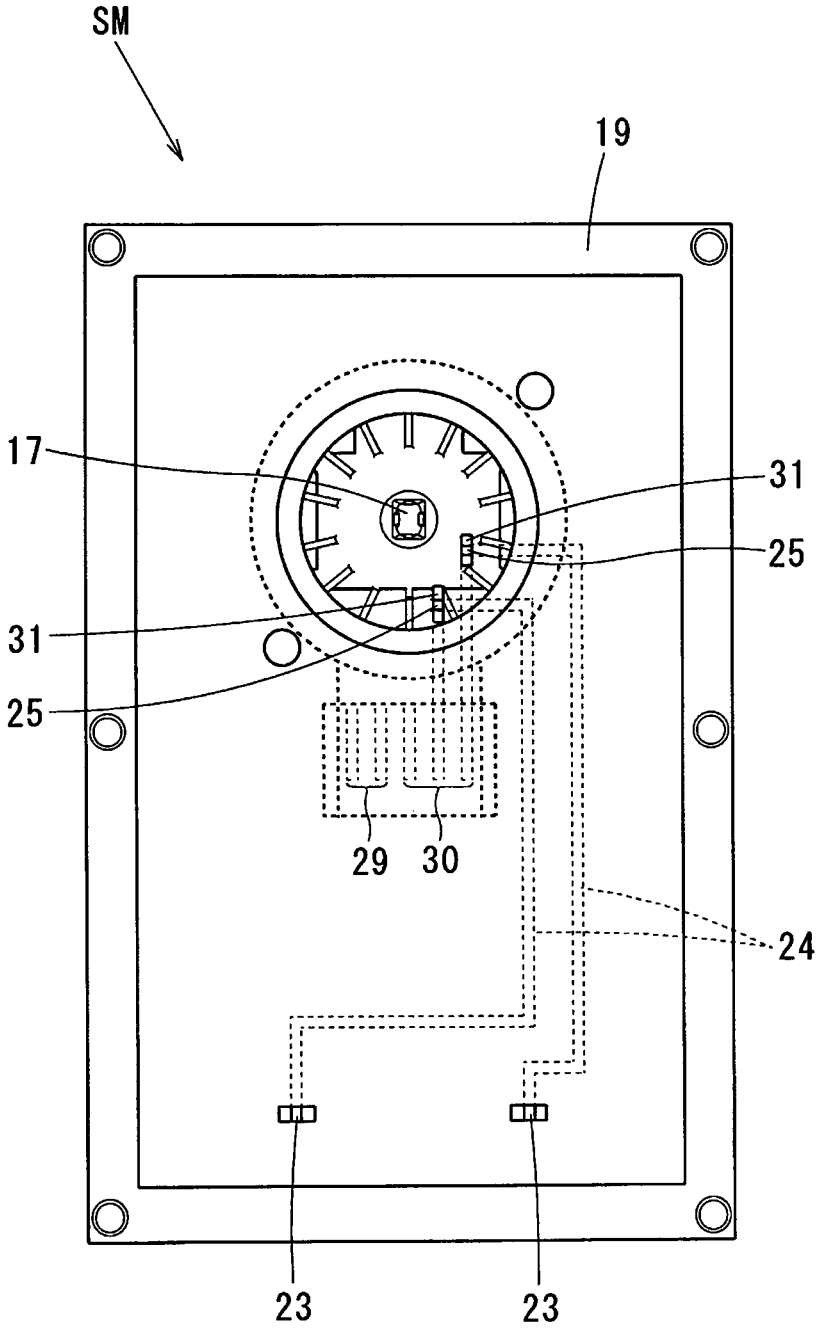
FIG. 4 is a plan view illustrating the sensor module of the first embodiment viewed from its back side.

As illustrated in FIG. 4, the sensor cover 19 includes a pair of pinching terminals 23 that are connected to a motor terminal 22 (see FIG. 1) on positive and negative sides, two motor conduction wires (conductor wires) 24 that are connected respectively to these pinching terminals 23, and a pair of relay terminals 25 that are connected respectively to the two motor conduction wires 24. The pinching terminal 23 is provided to branch in a two-pronged manner on its leading end side, and is such a female terminal that clamps with resilience the flat plate-shaped motor terminal 22 serving as a male terminal in its thickness direction. The motor conduction wire 24 is embedded in the sensor cover 19 to extend from an attachment position of the pinching terminal 23 to the ASSY receiving surface 21, and is electrically connected to the relay terminal 25 at an inner peripheral end of the ASSY receiving surface 21. Similar to the motor terminal 22, the relay terminal 25 is provided to serve as a flat plate-shaped male terminal, and projects upward from the ASSY receiving surface 21 as illustrated in FIG. 2. The relay terminal 25 can also be provided integrally with the motor conduction wire 24. Specifically, an end portion of the motor conduction wire 24 can also be bent to be used as the relay terminal 25.

The sensor assembly SA is configured by incorporation of the Hall IC 17, which is a sensor detection part of the present disclosure, into a sensor housing 26 made of resin. The sensor housing 26 includes a fitting part 26*a* for attachment to the sensor cover 19. This fitting part 26*a* has a cylindrical shape that is fitted into the attachment hole 20 of the sensor cover 19. A circumferential groove in which to attach an O-ring 27 is formed on an outer peripheral surface of the fitting part 26*a*. The sensor housing 26 includes a connector 28 for connection to the ECU through an external wiring (not shown). This connector 28 includes a connector housing 28*b* that is formed from resin integrally with the sensor housing 26, and connector terminals 29, 30 that are insert-molded in this connector housing 28*b*.

Figure 3:
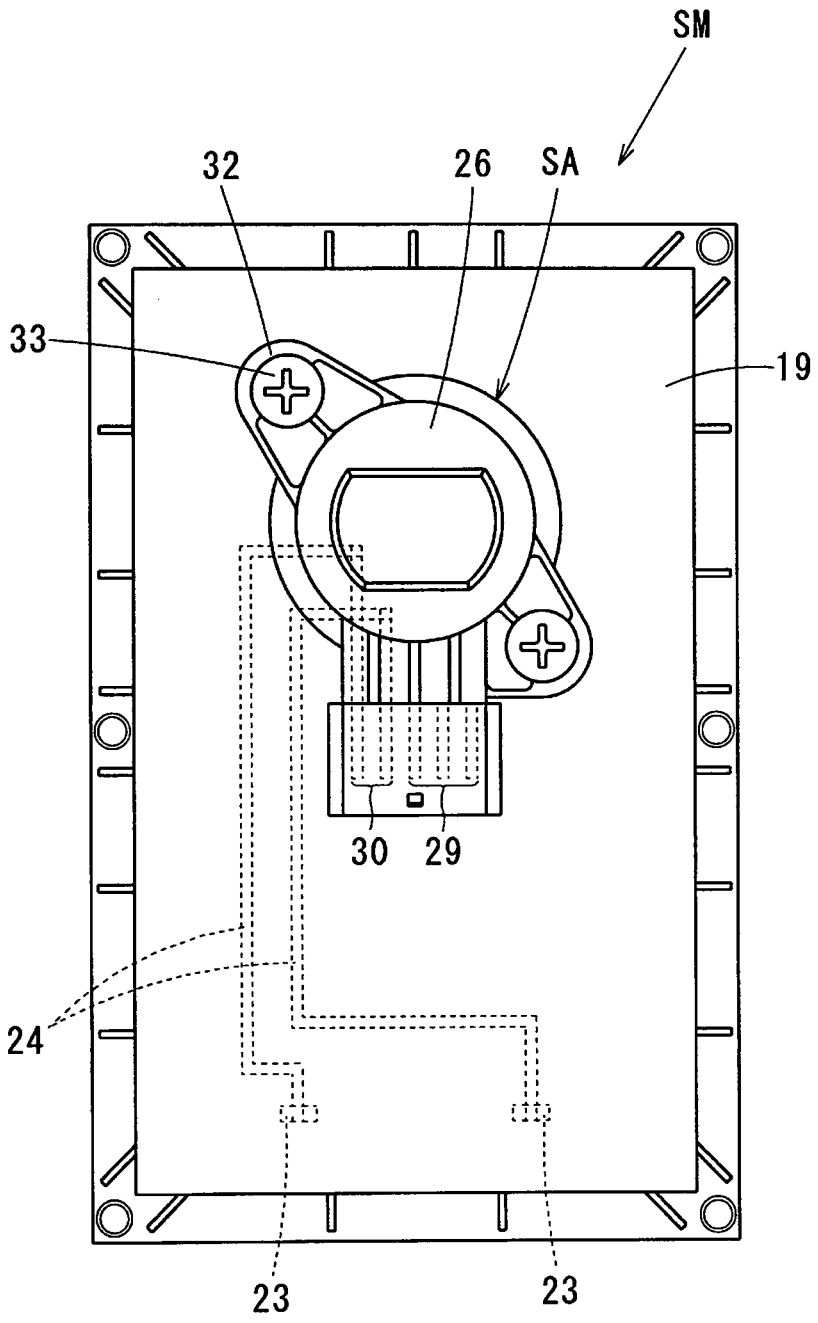
FIG. 3 is a plan view illustrating the sensor module of the first embodiment viewed from its front side.

As illustrated in FIGS. 3 and 4, the connector terminals 29, 30 are a sensor connector terminal (first connector terminal) 29 that is electrically connected to the Hall IC 17, and a motor connector terminal (second connector terminal) 30 that is electrically connected to the motor 10. Both the connector terminals 29, 30 are consolidated in the connector housing 28*b*. The sensor connector terminal 29 is connected directly or indirectly through internal wiring embedded in the sensor housing 26 to three connection terminals 17*a* (input terminal, output terminal, ground terminal) which are provided for the Hall IC 17. On the other hand, the motor connector terminal 30 is electrically connected to a pinching terminal 31 (see FIG. 2) which is attached to an inner side of the sensor housing 26, and this pinching terminal 31 is electrically connected to the above-described relay terminal 25 through male/female fitting. An electrical connection between the motor connector terminal 30 and the pinching terminal 31 can also be made via the internal wiring embedded in the sensor housing 26.

As illustrated in FIG. 2, the fitting part 26*a*, on which the O-ring 27 is attached, is fitted into the inner periphery of the attachment hole 20, so that the sensor assembly SA is attached to the sensor cover 19, and at the same time, the relay terminal 25 is inserted into the pinching terminal 31 to be electrically connected thereto. Then, as illustrated in FIG. 3, two attachment flanges 32 provided for the sensor housing 26 are fastened to the sensor cover 19 by screws 33 or the like to be fixed thereto. As illustrated in FIG. 1, the sensor module SM is attached to the throttle body 3 to cover an upper end side of the throttle body 3 in which the gear train is disposed, and is fixed to the throttle body 3 by fastening the sensor cover 19 to the throttle body 3 via screws or the like.

Operation and effects of the first embodiment will be described below. In the sensor module SM of the first embodiment, the sensor assembly SA is provided separately from the sensor cover 19. Accordingly, the sensor assembly SA can be made common to various sensor covers 19 having different attachment shapes. As a result, when an attachment shape of the sensor cover 19 attached to the throttle body 3 is changed, a design change of the entire sensor module SM including the sensor assembly SA is unnecessary, and only the sensor cover 19 needs to have its shape changed. Thus, when the sensor covers 19 having different attachment shapes are produced in small amounts, or when the sensor cover 19 having a special shape is produced, the sensor assembly SA can be made common. Consequently, the design of the sensor module SM can be efficiently changed. Furthermore, since the connector 28 is provided for the sensor housing 26 instead of the sensor cover 19, the case where the position of the connector 28 needs to be changed can easily be attended to. Therefore, the attachment position (circumferential position) of the sensor assembly SA to the sensor cover 19 only needs to be set in accordance with the required connector position.

In the sensor module SM described in the first embodiment, the Hall IC 17 is not attached to the sensor cover 19. Accordingly, every time when the attachment shape of the sensor cover 19 is changed, accuracy of the position of the Hall IC 17 does not need to be elaborated. As a result, an increase in cost involved in the shape change of the sensor cover 19 can be minimized. Moreover, at the time of attachment of the sensor assembly SA to the sensor cover 19, the pinching terminals 31 and the relay terminals 25 can be easily connected together only through male/female fitting. Furthermore, the two attachment flanges 32 provided for the sensor housing 26 only need to be fastened and fixed to the sensor cover 19 by the screws 33 or the like. Consequently, the sensor module SM can easily be assembled. In addition, the O-ring 27 is attached on the outer periphery of the fitting part 26*a* provided for the sensor housing 26, and the fitting part 26*a* is fitted into the attachment hole of the sensor cover 19. As a consequence, sealing properties can be ensured by the O-ring 27, and the accuracy of the position of the Hall IC 17 relative to the sensor cover 19 can be improved.

Another embodiment of the present disclosure will be described below. The same reference numeral as in the first embodiment is given to an illustration of a component or configuration in common with the first embodiment, and its detailed explanation will be omitted.

Second Embodiment

Figure 5:
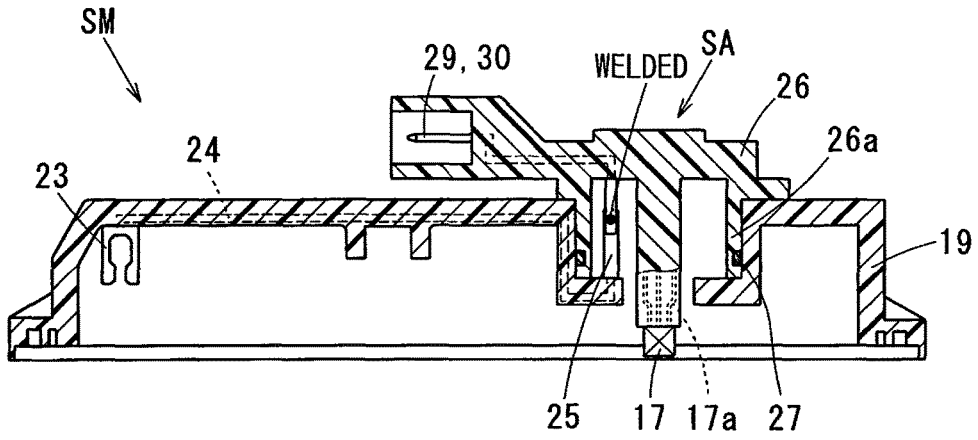
FIG. 5 is a sectional view illustrating a sensor module in accordance with a second embodiment.

This second embodiment is an example in which a motor connector terminal 30 and a relay terminal 25 are joined together by welding or the like as illustrated in FIG. 5 at an energizing path from the motor connector terminal 30 to a motor terminal 22. In this case, the pinching terminal 31 of the first embodiment can be eliminated. Accordingly, a cost-cutting effect can be produced by reduction of the number of components.

Modifications to the above embodiment will be described below. In the first embodiment, there has been described an example of application of the sensor module SM of the present disclosure to the electronic throttle 1. However, the first embodiment is not limited to the electronic throttle 1. For example, the sensor module SM can be applied to an exhaust gas recirculation (EGR) system that recirculates a part of exhaust gas discharged from an engine to an air-intake side. In the first embodiment, there has been described an example of the sensor assembly SA being fixed to the sensor cover 19 by the screws 33. However, for example, the sensor assembly SA may be fixed by welding, adhesive joining, laser welding or the like.

To sum up, the sensor module SM in accordance with the above embodiments can be described as follows.

A sensor module SM is adapted to be attached to an actuator body 3 incorporating an electric actuator 10. The sensor module SM includes a sensor assembly SA, a sensor cover 19, and a connector housing 28*b*. The sensor assembly SA includes a sensor detection part 17 and a sensor housing 26. The sensor detection part 17 is configured to detect a physical change amount of a driven body 7 driven by the electric actuator 10 and to convert the physical change amount into an electrical signal. The sensor housing 26 incorporates the sensor detection part 17. The sensor cover 19 is provided separately from the sensor housing 26 and is attached to the actuator body 3. The sensor module SM is configured integrally by attaching the sensor assembly SA to the sensor cover 19. A connector terminal 29 electrically connected to a connection terminal 17*a* of the sensor detection part 17 is insert-molded in the connector housing 28*b*. The connector housing 28*b* is provided integrally with the sensor housing 26.

As a result of the above-described configuration, the sensor detection part 17 is incorporated in the sensor housing 26 to configure the sensor assembly SA, and this sensor assembly SA is provided separately from the sensor cover 19. Accordingly, the sensor assembly SA can be made common to various sensor covers 19 having different shapes. As a result, when an attachment shape of the sensor cover 19 attached to the actuator body (3) is changed, a design change of the entire sensor module SM including the sensor assembly SA is unnecessary, and only the sensor cover 19 needs to have its shape changed. Consequently, a design change can be carried out efficiently for small-quantity production or special shapes. Moreover, because the connector 28 is provided for the sensor housing 26 instead of the sensor cover 19, the position change of the connector 28 can easily be attended to. Specifically, the attachment position (circumferential position) of the sensor assembly SA to the sensor cover 19 only needs to accord with the position of the connector 28. In addition, in sensor module SM of the present disclosure, the sensor detection part 17 is not attached to the sensor cover 19. Consequently, every time when the attachment shape of the sensor cover 19 is changed, accuracy of the position of the sensor detection part 17 does not need to be elaborated.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

What is claimed is:

1. A sensor module adapted to be attached to an actuator body incorporating an electric actuator, the sensor module comprising:

a sensor assembly that includes:

a sensor detection part configured to detect a physical change amount of a driven body driven by the electric actuator and to convert the physical change amount into an electrical signal; and a sensor housing incorporating the sensor detection part;

a sensor cover that is provided separately from the sensor housing and is attached to the actuator body, wherein the sensor module is configured integrally by attaching the sensor assembly to the sensor cover; and a connector housing in which a connector terminal electrically connected to a connection terminal of the sensor detection part is insert-molded, wherein the connector housing and the sensor housing are provided as a one-piece body, wherein:

the sensor cover includes a cylindrical attachment hole that opens to be circular in cross-section; and the sensor housing includes a fitting part corresponding to the attachment hole, the sensor module further comprising an O-ring that is attached on an outer periphery of the fitting part, wherein the fitting part is fitted into an inner periphery of the attachment hole via the O-ring, so that the sensor assembly is attached to the sensor cover; and a central axis of the driven body passes through a center of the O-ring and through the sensor detection part.

2. The sensor module according to claim 1, wherein:

the connector terminal is a first connector terminal;

a connector terminal that is electrically connected to a connection terminal of the electric actuator is a second connector terminal; and the first connector terminal and the second connector terminal are consolidated in the connector housing.

3. The sensor module according to claim 2, further comprising a conductor wire that is embedded in the sensor cover, wherein the conductor wire makes an electrical connection between the connection terminal of the electric actuator and the second connector terminal.

* * * * *